US009566554B2

(12) United States Patent
Wu et al.

(10) Patent No.: US 9,566,554 B2
(45) Date of Patent: Feb. 14, 2017

(54) ADJUSTABLE PULSED GAS AGITATOR

(71) Applicant: Memstar Pte Ltd, Singapore (SG)

(72) Inventors: Xiangdong Wu, Singapore (CN); Hailin Ge, Singapore (CN)

(73) Assignee: MEMSTAR PTE LTD, Singapore (SG)

( * ) Notice: Subject to any disclaimer, the term of this patent is extended or adjusted under 35 U.S.C. 154(b) by 0 days.

(21) Appl. No.: 14/907,823

(22) PCT Filed: Jul. 31, 2013

(86) PCT No.: PCT/SG2013/000322

§ 371 (c)(1),
(2) Date: Jan. 27, 2016

(87) PCT Pub. No.: WO2015/016770

PCT Pub. Date: Feb. 5, 2015

(65) Prior Publication Data

US 2016/0166994 A1 Jun. 16, 2016

(51) Int. Cl.
*B01F 3/04* (2006.01)
*B01F 13/02* (2006.01)

(52) U.S. Cl.
CPC ..... *B01F 3/0412* (2013.01); *B01F 13/0283* (2013.01); *B01F 2003/04163* (2013.01);
(Continued)

(58) Field of Classification Search
CPC ..... B01F 3/0412; B01F 13/0283; B01F 2003/04141; B01F 2003/04163; B01F 2003/04205; B01F 2003/04234
(Continued)

(56) References Cited

U.S. PATENT DOCUMENTS 4,005,014 A * 1/1977 Wikey ..... B01F 3/04106 210/192
4,416,546 A * 11/1983 Parkins ..... E03F 5/26 366/102

(Continued)

FOREIGN PATENT DOCUMENTS

| | | | |
|---|---|---|---|
| CA | 2628167 | A1 | 8/2006 |
| CN | 202519289 | U | 11/2012 |
| DE | 19517901 | C1 | 10/1996 |

OTHER PUBLICATIONS

International Search Report of International Application No. PCT/SG2013/000322 completed Oct. 30, 2013 and mailed Oct. 30, 2013 (4 pages).

(Continued)

*Primary Examiner* — Charles Bushey
(74) *Attorney, Agent, or Firm* — Pyprus Pte Ltd

(57) ABSTRACT

The present invention provides an adjustable pulsed gas agitator including a gas accumulation chamber with a gas discharge pipe, a gas supply unit, and an adjustable gas discharge unit. The adjustable gas discharge unit has an elongatable gas pipe slidably disposed over the lower part of the gas discharge pipe, and a gas cap disposed underneath the elongatable gas pipe; so that when the adjustable gas discharge unit is moved upward or downward, the volume of the stirring gas accumulated within the gas accumulation chamber is decreased or increased; thereby the frequency and strength of the discharged pulsed gas flows is varied.

11 Claims, 6 Drawing Sheets

(52) U.S. Cl.
CPC ..... *B01F 2003/04205* (2013.01); *B01F 2003/04234* (2013.01)

(58) Field of Classification Search
USPC ..... 261/62, 64.1, 81, 121.1
See application file for complete search history.

(56) References Cited

U.S. PATENT DOCUMENTS

| | | | | | |
|---|---|---|---|---|---|
| 4,844,844 | A * | 7/1989 | Levy | F23G 7/085 | 137/251.1 |
| 5,100,242 | A * | 3/1992 | Latto | B01F 11/0082 | 366/118 |
| 6,036,357 | A * | 3/2000 | Van Drie | B01F 3/04113 | 366/101 |
| 6,406,624 | B1 * | 6/2002 | DeVos | B01D 21/0027 | 210/208 |
| 6,488,270 | B2 * | 12/2002 | Whiteis | B01F 3/04248 | 261/121.1 |
| 6,824,125 | B2 * | 11/2004 | Thomas | A01K 63/042 | 261/121.1 |
| 7,300,040 | B2 * | 11/2007 | Thomas | B01F 3/04241 | 261/123 |
| 8,763,995 | B2 * | 7/2014 | Hintz | A01K 63/042 | 261/121.1 |
| 2007/0200260 | A1 * | 8/2007 | Whiteis | A01K 63/006 | 261/64.3 |

OTHER PUBLICATIONS

Written Opinion of International Application No. PCT/SG2013/000322 completed Oct. 30, 2013 and mailed Oct. 30, 2013 (4 pages).

* cited by examiner (a) (b)

ADJUSTABLE PULSED GAS AGITATOR

FIELD OF THE INVENTION

The present invention relates generally to gas/liquid agitation or mixing, and more particularly to an adjustable pulsed gas agitator that can change the strength of discharged gas bubbles.

BACKGROUND OF THE INVENTION

Liquid could be mixed by machinery and propeller, perpetuated by the liquid itself through pumped circulation, and agitated by other means. Gas mixing has the advantages of scouring action and flotation effect. The scouring action can be used to cleanse a surface such as a wall surface of hollow fiber membrane and a reactor. The flotation effect can contribute to the uniform suspension of solid particles in liquid without precipitation.

Gas mixing may be continuous, or intermittent or pulsed. Continuous gas mixing is simple, generally achieved using an aeration device such as aeration diffusers for providing a continuous gas supply. Mixing requires water turbulence. Intermittent gas agitation can obtain the water turbulence with lower energy by their discrete bubble stirring but continuous gas agitation requires higher energy consumption for same purpose. In many cases, the agitated liquid requires a period of time such as a few seconds to become calm; non-oriented continuous gas supply instead causes the offset of the energy. Intermittent gas supply can be realized by valve switches, but frequent switching particularly the frequency within the range of a few seconds, will cause fatigue failure of the valve. Pulsed gas agitator being made by using of the principle of the abrupt change of air pressure has no mechanical change; the gas supply could be continuous, but the gas discharge could be pulsed.

The immersed ultrafiltration/microfiltration hollow fiber membrane has been widely used in liquid-solid separation process, such as membrane bioreactor (MBR) used in the sewage treatment process, and membrane chemical reactor (MCR) used in the water treatment and recycling process. In these processes, air scouring is crucial in order to prevent the film surface from being contaminated. However, since air scouring requires higher energy consumption, how to save energy and achieve a predetermined air scouring effect has become a key technology. Gas wash can swing the membrane fibers, so that the contaminants cannot be accumulated on the membrane surface. At the same time, the gas makes the solids such as sludge or flocculant to be evenly distributed in the liquid.

Although mechanical agitation is effective in the liquid-liquid and liquid-solid mixing processes, they are sometimes subject to the limitations of the medium, for example, strong acids and high salinity of the liquid have a corrosive effect on metal. Using an inert gas as the stirring power can overcome such insufficiencies.

SUMMARY OF THE INVENTION

The present invention provides an adjustable pulsed gas agitator. In one embodiment, the adjustable pulsed gas agitator comprises a gas accumulation chamber with an inverted enclosure having a downward liquid communicable opening when immersed in a liquid and having a gas discharge pipe through the top of the gas accumulation chamber; a gas supply unit for providing a stirring gas at a position higher than the downward liquid communicable opening within the gas accumulation chamber so that the stirring gas is accumulated within the gas accumulation chamber; and an adjustable gas discharge unit for discharging the stirring gas accumulated within the gas accumulation chamber intermittently in the form of pulsed gas flows, wherein the adjustable gas discharge unit comprises an elongatable gas pipe slidably disposed over the lower part of the gas discharge pipe, and a gas cap disposed underneath the elongatable gas pipe; so that when the adjustable gas discharge unit is moved upward or downward, the volume of the stirring gas accumulated within the gas accumulation chamber is decreased or increased; thereby the frequency and strength of the discharged pulsed gas flows is varied.

In another embodiment of the adjustable pulsed gas agitator, the gas accumulation chamber has a rectangular or cylindrical configuration.

In another embodiment of the adjustable pulsed gas agitator, the gas supply unit comprises a gas supply pipe in a gas communication with an external gas supply source. In a further embodiment of the adjustable pulsed gas agitator, the external gas supply source is continuous, intermittent or fluctuated. In another further embodiment of the adjustable pulsed gas agitator, the gas supply unit further comprises a gas supply nozzle disposed at the distal end of the gas supply pipe for control of the supplied gas flow.

In another embodiment of the adjustable pulsed gas agitator, the gas cap has a side wall with a variable height and a bottom preventing the liquid from directly flowing through the gas cap, and the distance between the bottom tip of the elongatable gas pipe and the bottom of the gas cap is changeable.

In another embodiment, the adjustable pulsed gas agitator further comprises a secure means between the gas discharge pipe and the elongatable gas pipe so as to prevent the air accumulated within the gas accumulation chamber from escaping from the gap between the gas discharge pipe and elongatable gas pipe.

In another embodiment, the adjustable pulsed gas agitator, the adjustable gas discharge unit further comprises three or more radial supports integrally connecting the elongatable gas pipe and the gas cap so that they can be moved together upward and downward. In a further embodiment of the adjustable pulsed gas agitator, the adjustable gas discharge unit further comprises a translational means that is coupled to the bottom of the gas cap for moving the adjustable gas discharge unit upward and downward.

In another embodiment, the adjustable pulsed gas agitator further comprises a pipe size controller that can be removably plugged into the gas discharge pipe, wherein the pipe size controller can be changed with different inner diameters for changing the size and shape of the discharged gas bubbles.

In another embodiment, the adjustable pulsed gas agitator further comprises an adjustable partition disposed within the gas accumulation chamber, wherein the adjustable partition can change the volume of the gas chamber so as to control the volume of the discharged bubbles.

In the process of gas mixing, the frequency and intensity of mixing bubbles are the key factors for controlling the mixing effects. Therefore, by mechanically controlling the parts of a mixer depending upon the mixing requirements, the release frequency and intensity of mixing bubbles are so adjusted as to achieve optimal mixing effect; this is the biggest advantage of an adjustable gas mixer over a static gas mixer.

The objectives and advantages of the invention will become apparent from the following detailed description of preferred embodiments thereof in connection with the accompanying drawings.

BRIEF DESCRIPTION OF THE DRAWINGS

Preferred embodiments according to the present invention will now be described with reference to the Figures; in which like reference numerals denote like elements.

DETAILED DESCRIPTION OF THE INVENTION

The present invention may be understood more readily by reference to the following detailed description of certain embodiments of the invention.

Throughout this application, where publications are referenced, the disclosures of these publications are hereby incorporated by reference, in their entireties, into this application in order to more fully describe the state of art to which this invention pertains.

The present invention provides an adjustable pulsed gas agitator for being used in situations where pulsed gas flows are needed to provide for liquid mixing. Briefly, the adjustable pulsed gas agitator of the present invention employs an adjustable gas discharge unit so that the velocity and strength of the discharged gas could be varied according to the requirements of practical applications.

Figure 1:
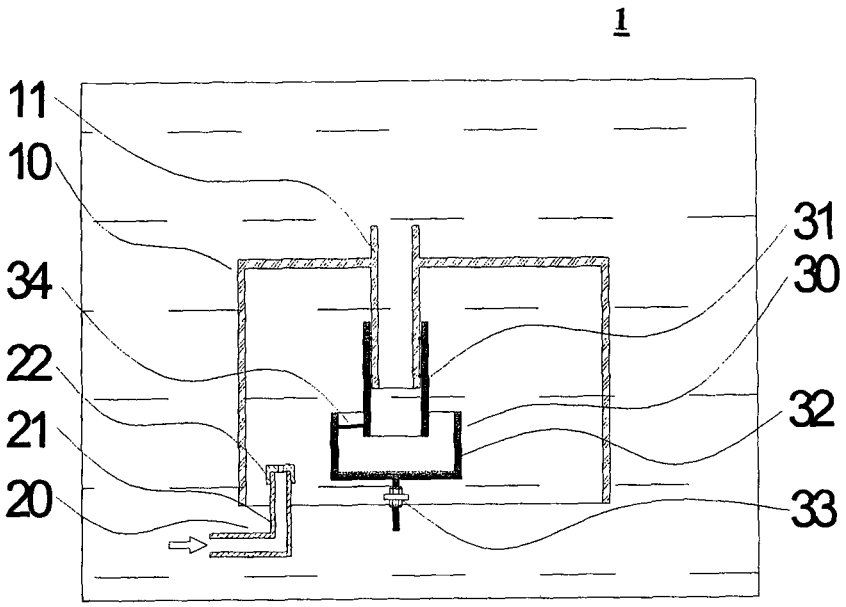
FIG. 1 shows a cross-section view of the adjustable pulsed gas agitator in accordance with one embodiment of the present invention.

Referring now to FIG. 1, there is provided an adjustable pulsed gas agitator in accordance with one embodiment of the present invention. As shown in FIG. 1, the adjustable pulsed gas agitator 1 comprises a gas accumulation chamber 10 with an inverted enclosure having a downward liquid communicable opening when immersed in a liquid, a gas supply unit 20 for providing a stirring gas at a position higher than the downward liquid communicable opening within the gas accumulation chamber 10, and an adjustable gas discharge unit 30 for discharging a pulsed gas flow according to the gas volume accumulated within the gas accumulation chamber 10.

The gas accumulation chamber 10 can have various shapes and configurations. In certain embodiments, it has a rectangular or cylindrical configuration. The gas accumulation chamber 10 has a gas discharge pipe 11 through its top as shown in FIG. 1, where the gas discharge pipe 11 allows the liquid pass through the gas accumulation chamber.

The gas supply unit 20 is preferably providing a continuous gas supply; but the gas supply is not so limited; varying gas supplies can be used as long as the requirement of discharging pulsed gases according to specific applications can be satisfied. As shown in FIG. 1, the gas supply unit 20 comprises a gas supply pipe 21 in a gas communication with an external gas supply source (not shown), where the external gas supply source can be continuous, intermittent or fluctuated, preferably continuous. In certain embodiments, the gas supplied is air. In certain embodiments, the supply gas is any purified gas suitable for any specific application. The gas supply unit 20 further comprises a gas supply nozzle 22 with a gas supply orifice disposed at the distal end of the gas supply pipe 21 for control of the supplied gas flow. In certain embodiments, the gas supply nozzle is a large resistance gas supply device to prevent uneven distribution when the paralleled adjustable pulsed gas agitators work together and gas supply nozzles are not installed in an exact level.

Figure 2:
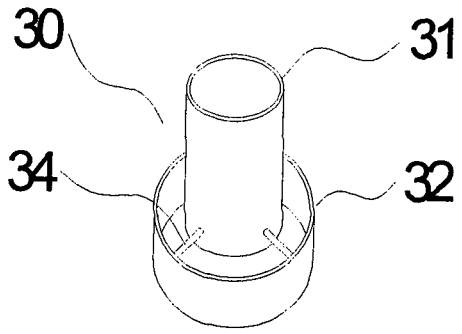
FIG. 2 shows an isometric view of the adjustable gas discharge unit in accordance with one embodiment of the present invention.

The adjustable gas discharge unit 30 comprises an elongatable gas pipe 31 slidably disposed over the lower part of the gas discharge pipe 11, and a gas cap 32 disposed underneath the elongatable gas pipe 31. In certain embodiments, the gas discharge pipe 11, elongatable gas pipe 31 and gas cap 32 have a cylindrical configuration. The gas cap 32 has a side wall with a variable height according to practical applications and a bottom preventing the liquid from directly flowing through the gas cap 32. The distance between the bottom tip of the elongatable gas pipe 31 and the bottom of the gas cap 32 is changeable according to practical applications. When the gas discharge pipe 11, elongatable gas pipe 31 and gas cap 32 are assembled, a fluid communication is established between the external space and the internal one within the gas accumulation chamber 10 so that the gas accumulated within the gas accumulation chamber 10 is discharged to the external fluid in a pulsed flow of gas bubbles. For the existence of the elongatable gas pipe 31, the overall length of the passage for discharging the pulsed flow of gas bubbles can be adjusted so as to control the pulse frequency. In certain embodiments, a secure means between the gas discharge pipe 11 and elongatable gas pipe 31 may be provided to secure the elongatable gas pipe 31 in its position, where the secure means can be any suitable ones such as bolts or locks. In certain embodiments, the secure means between the gas discharge pipe and the elongatable gas pipe is used to prevent the air accumulated within the gas accumulation chamber from escaping from the gap between the gas discharge pipe and elongatable gas pipe. In certain embodiments, The adjustable gas discharge unit 30 further comprises three or more radial supports 34 integrally connecting the elongatable gas pipe 31 and the gas cap 32 as shown in FIG. 2, where the gas cap 32 is securely fixed to the elongatable gas pipe 31 so that they can be moved together upward and downward. The adjustable gas discharge unit 30 further comprises a translational means 33 such as two nuts on a bolt that fixes the adjustable gas discharge unit 30 and adjusts it upward and downward.

Figure 3:
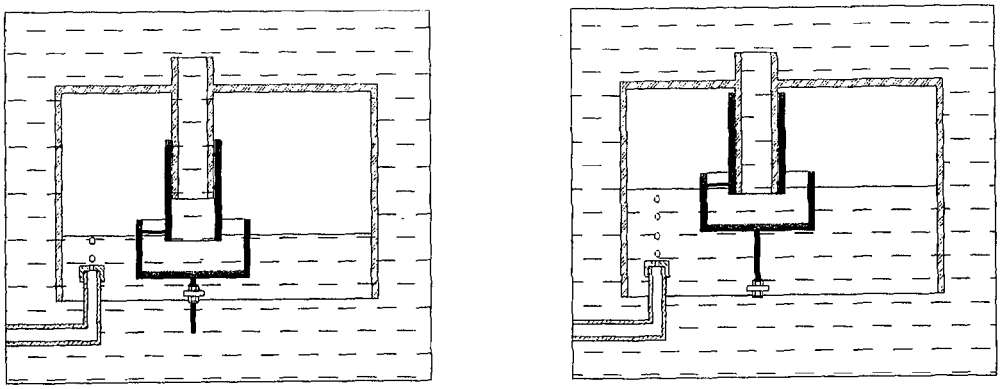
FIG. 3 illustrates the adjustment of the gas volume accumulated with the gas accumulation chamber by adjusting the position of the adjustable gas discharge unit.

FIG. 3 illustrates the adjustment of the gas volume accumulated with the gas accumulation chamber by adjusting the position of the adjustable gas discharge unit; (a) when the adjustable gas discharge unit is moving downward, the volume of the gas accumulated within the gas accumulation chamber is increased, resulting in the increase of the strength of the discharged gas bubbles; and (b) when the adjustable gas discharge unit is moving upward, the volume of the gas accumulated within the gas accumulation chamber is decreased, resulting in the decrease of the strength of the discharged gas bubbles.

Figure 4:
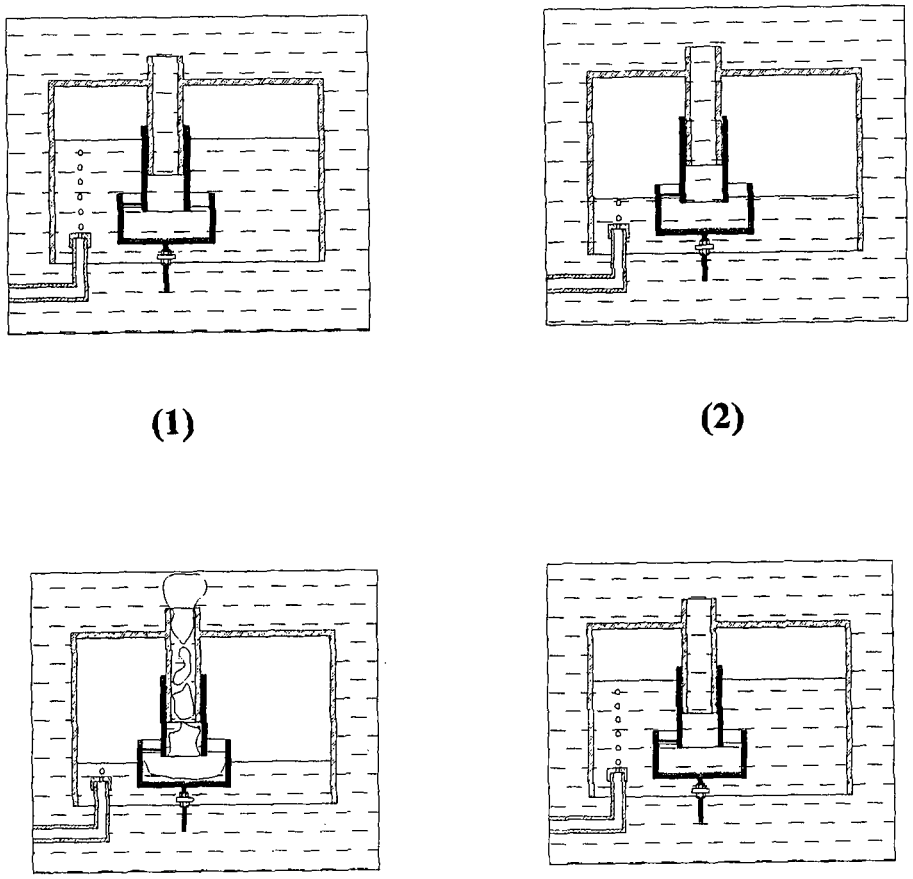
FIG. 4 illustrates the operation of the adjustable pulsed gas agitator in accordance with one embodiment of the present invention.

FIG. 4 illustrates the operation of the pulsed gas agitator in accordance with one embodiment of the present invention; (1) commencing the supply of small non-oriented continuous gas into the gas accumulation chamber; (2) increasing the gas volume and pressure; (3) discharging the pressured gas from the gas accumulation chamber to release pressured pulsed gas flows; and (4) repeating the accumulation of gas within the gas accumulation chamber.

In certain embodiments, the adjustable pulsed gas agitator 1 further comprises a pipe size controller that can be removably plugged into the gas discharge pipe 11. The pipe size controller can be changed with different inner diameters for changing the size and shape of the discharged gas bubbles.

Figure 5:
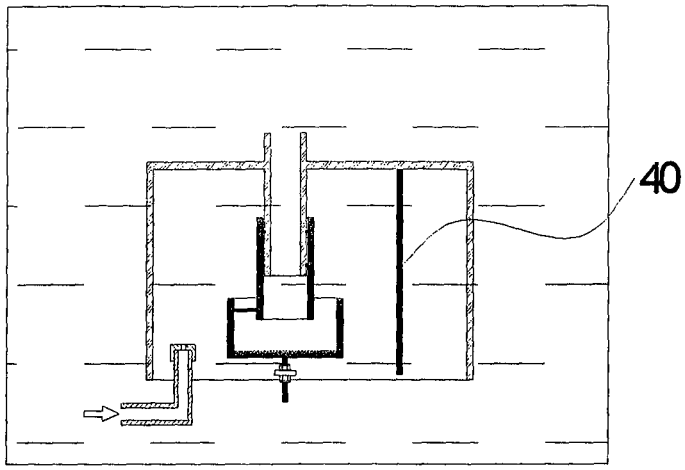
FIG. 5 shows a cross-section view of the adjustable pulsed gas agitator in accordance with another embodiment of the present invention.

Referring now to FIG. 5, in certain embodiments, the adjustable pulsed gas agitator 1 further comprises an adjustable partition 40 disposed within the gas accumulation chamber 10, where the adjustable partition 40 can change the volume of the gas chamber so as to control the volume of the discharged gas bubbles. The partition is made as a close fitting plug, when it is pushed toward the gas discharge unit 30, the volume of gas accumulation chamber will be reduced, vice versa, the volume increased. This volume determines the release volume for each gas accumulation period.

Figure 6:
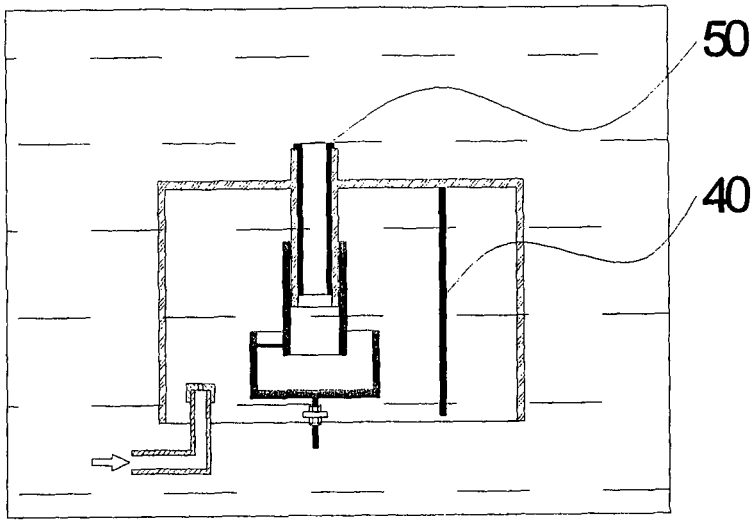
FIG. 6 shows a cross-section view of the adjustable pulsed gas agitator in accordance with another embodiment of the present invention.

Referring now to FIG. 6, in certain embodiments, the adjustable pulsed gas agitator 1 further comprises a pipe size controller 50 that can be removably plugged into the gas discharge pipe, wherein the pipe size controller can be changed with different inner diameters for changing the size and shape of the discharged gas bubbles.

While the present invention has been described with reference to particular embodiments, it will be understood that the embodiments are illustrative and that the invention scope is not so limited. Alternative embodiments of the present invention will become apparent to those having ordinary skill in the art to which the present invention pertains. Such alternate embodiments are considered to be encompassed within the scope of the present invention. Accordingly, the scope of the present invention is defined by the appended claims and is supported by the foregoing description.

What is claimed is:

1. An adjustable pulsed gas agitator comprising:

a gas accumulation chamber with an inverted enclosure having a downward liquid communicable opening when immersed in a liquid and having a gas discharge pipe through the top of the gas accumulation chamber;

a gas supply unit for providing a stirring gas at a position higher than the downward liquid communicable opening within the gas accumulation chamber so that the stirring gas is accumulated within the gas accumulation chamber; and an adjustable gas discharge unit for discharging the stirring gas accumulated within the gas accumulation chamber intermittently in the form of pressured pulsed gas flows, wherein the adjustable gas discharge unit comprises an elongatable gas pipe slidably disposed over the lower part of the gas discharge pipe, and a gas cap disposed underneath the elongatable gas pipe;

so that when the adjustable gas discharge unit is moved upward or downward, the volume of the stirring gas accumulated within the gas accumulation chamber is decreased or increased; thereby the frequency and strength of the discharged pulsed gas flows is varied.

2. The adjustable pulsed gas agitator of claim 1, wherein the gas accumulation chamber has a rectangular or cylindrical configuration.

3. The adjustable pulsed gas agitator of claim 1, wherein the gas supply unit comprises a gas supply pipe in a gas communication with an external gas supply source.

4. The adjustable pulsed gas agitator of claim 3, wherein the external gas supply source is continuous, intermittent or fluctuated.

5. The adjustable pulsed gas agitator of claim 3, wherein the gas supply unit further comprises a gas supply nozzle disposed at the distal end of the gas supply pipe for control of the supplied gas flow.

6. The adjustable pulsed gas agitator of claim 1, wherein the gas cap has a side wall with a variable height and a bottom preventing the liquid from directly flowing through the gas cap, and the distance between the bottom tip of the elongatable gas pipe and the bottom of the gas cap is changeable.

7. The adjustable pulsed gas agitator of claim 1, further comprising a secure means between the gas discharge pipe and the elongatable gas pipe so as to prevent the air accumulated within the gas accumulation chamber from escaping from the gap between the gas discharge pipe and elongatable gas pipe.

8. The adjustable pulsed gas agitator of claim 1, wherein the adjustable gas discharge unit further comprises three or more radial supports integrally connecting the elongatable gas pipe and the gas cap so that they can be moved together upward and downward.

9. The adjustable pulsed gas agitator of claim 8, wherein the adjustable gas discharge unit further comprises a translational means that is coupled to the bottom of the gas cap for moving the adjustable gas discharge unit upward and downward.

10. The adjustable pulsed gas agitator of claim 1, further comprises a pipe size controller that can be removably plugged into the gas discharge pipe, wherein the pipe size controller can be changed with different inner diameters for changing the size and shape of the discharged gas bubbles.

11. The adjustable pulsed gas agitator of claim 1, further comprises an adjustable partition disposed within the gas accumulation chamber, wherein the adjustable partition can change the volume of the gas chamber so as to control the volume of the discharged gas bubbles.

* * * * *